US005259182A

United States Patent [19]

Iwai et al.

[11] Patent Number: 5,259,182

[45] Date of Patent: Nov. 9, 1993

[54] COMBUSTION APPARATUS AND COMBUSTION METHOD THEREIN

[75] Inventors: Kazumi Iwai, Mito; Hiromi Koizumi, Hitachi; Kazuhiko Kumata, Katsuta; Yoshikazu Moritomo, Hitachi, all of Japan

[73] Assignee: Hitachi, Ltd., Tokyo, Japan

[21] Appl. No.: 17,174

[22] Filed: Feb. 12, 1993

Related U.S. Application Data

[63] Continuation of Ser. No. 623,502, Dec. 7, 1990, abandoned.

[30] Foreign Application Priority Data

Dec. 22, 1989 [JP] Japan ..... 1-331329

[51] Int. Cl.[5] ..... F23R 3/06

[52] U.S. Cl. ..... 60/39.06; 60/757

[58] Field of Search ..... 60/39.06, 748, 755, 60/756, 757, 734

[56] References Cited

U.S. PATENT DOCUMENTS

| | | | |
|---|---|---|---|
| 2,625,792 | 1/1953 | McCarthy et al. | 60/757 |
| 2,654,996 | 10/1953 | Boninsegni . | |
| 3,113,431 | 12/1963 | Janes et al. | 60/757 |
| 3,420,058 | 1/1969 | Howald et al. | 60/757 |
| 3,736,747 | 6/1973 | Warren | 60/755 |
| 3,751,910 | 8/1973 | Sweeney et al. | 60/757 |
| 3,793,827 | 2/1974 | Ekstedt . | |
| 3,826,082 | 7/1974 | Smuland et al. | 60/757 |
| 4,050,241 | 9/1977 | DuBell | 60/757 |
| 4,949,545 | 8/1990 | Shekleton | 60/756 |

FOREIGN PATENT DOCUMENTS

| | | | |
|---|---|---|---|
| 1310258 | 12/1962 | France . | |
| 1540599 | 9/1968 | France . | |
| 46-11525 | 3/1971 | Japan | 60/757 |
| 1089467 | 11/1967 | United Kingdom | 60/757 |
| 1135670 | 12/1968 | United Kingdom . | |
| 1503921 | 3/1978 | United Kingdom . | |

*Primary Examiner*—Richard A. Bertsch
*Assistant Examiner*—Timothy S. Thorpe
*Attorney, Agent, or Firm*—Antonelli, Terry, Stout & Kraus

[57] ABSTRACT

A combustion apparatus comprises a combustor liner forming a combustion chamber, and a swirler for introducing a fuel gas into the combustion chamber in the form of a swirl. The combustor liner has an air film forming device provided on the wall thereof and capable of forming a film of cooling air on the inner peripheral wall of the combustor liner so as to protect the combustor liner from the hot combustion gas in the combustion chamber. The air film forming means is formed such that the flowing direction of the air forming the film becomes the same direction as the swirling direction of the combustion gas, so that the film of the cooling air is not broken by the hot combustion gas.

11 Claims, 4 Drawing Sheets

COMBUSTION APPARATUS AND COMBUSTION METHOD THEREIN

This is a continuation of application Ser. No. 623,502, filed Dec. 7, 1990, now abandoned.

BACKGROUND OF THE INVENTION

The present invention relates to a combustion apparatus used, for example, in a gas turbine combustion method in such combustion apparatus and, more particularly, a combustion apparatus including a liner forming a combustion chamber, with an air film forming means for protecting the liner from the hot combustion gas.

A combustion apparatus of the aforementioned type generally includes a combustor liner which forms a combustion chamber, with the with liner being provided with various cooling means for protecting the liner from the hot combustion gas.

One cooling means includes a film of air, with air being introduced into the combustor through an air film forming means provided in the liner portion so as to always form a layer of air film on the inner wall of the liner. The air layer effectively prevents the heat in the combustion zone from reaching the liner and carries the heat away from the liner itself.

The above described cooling method offers a high cooling efficiency with a small quantity of air so as to effectively prevent overheating of the liner, since the air not only carries the heat away from the liner but also interrupts heat transfer to the liner, unlike a cooling method in which the heated liner is merely cooled. In addition, this method is simple in its arrangement and practical, so that it has been used widely.

In this cooling method, it is important that a uniform layer of air film is always formed over the entire area of the inner wall of the liner.

This of course requires an arrangement for forming such a uniform air film. However, what is more important is that the air film is not broken or punctured by the swirling flow of combustion gas in the combustion chamber formed by the liner. In the combustor of this type, the swirling flow is imparted to the feeding mixed gas, in order to attain a better mixing of fuel with air and to facilitate holding of the flame. Consequently, the combustion gas also becomes a part of the swirling flow, so that the air film is easily broken by this swirling combustion gas.

In recent years, there is a trend to use low caloric fuels such as blast furnace gas or the like. When such a fuel is used, the flow rate of the fuel to be supplied is increased with the result that the diameter of a nozzle for jetting the fuel is also increased. Consequently, the size of the swirler for imparting the swirling flow to the feeding gas is increased correspondingly, so that the influence of the combustion gas flow extends to the vicinity of the liner's inner wall thereby resulting in an easy breaking of the air film.

This problem would be eliminated by using a combustor liner having a greater diameter so as to reduce the influence of the combustion gas flow. Such a countermeasure, however, does not cope with the current demand for reduction in the size of the combustor liner. An increase in the liner diameter correspondingly increases the area of the liner surface which, in turn, requires a greater flow rate of the cooling air.

SUMMARY OF THE INVENTION

Accordingly, an object of the present invention is to provide a combustion apparatus of the type mentioned above, in which the air film is difficult to be broken, without increasing the diameter of the combustor liner.

To this end, according to the present invention, there is provided a combustion apparatus in which air film forming means for forming a film of air is so constructed that the flowing direction of the jetted air is in the same direction as the swirling direction of the combustion gas.

When the combustion apparatus is constructed in this manner, since the film is formed by the air which flows in the same direction as the swirling direction of the combustion gas, the air film is never broken by the combustion gas even if the swirling combustion gas approaches the air film. Thus, exfoliation or turbulency of the air film is suppressed, thereby increasing the cooling efficiency.

The above and other objects, features and advantages of the present invention will become clear from the following description when read in conjunction with the accompanying drawings.

DESCRIPTION OF THE PREFERRED EMBODIMENTS

Figure 3:
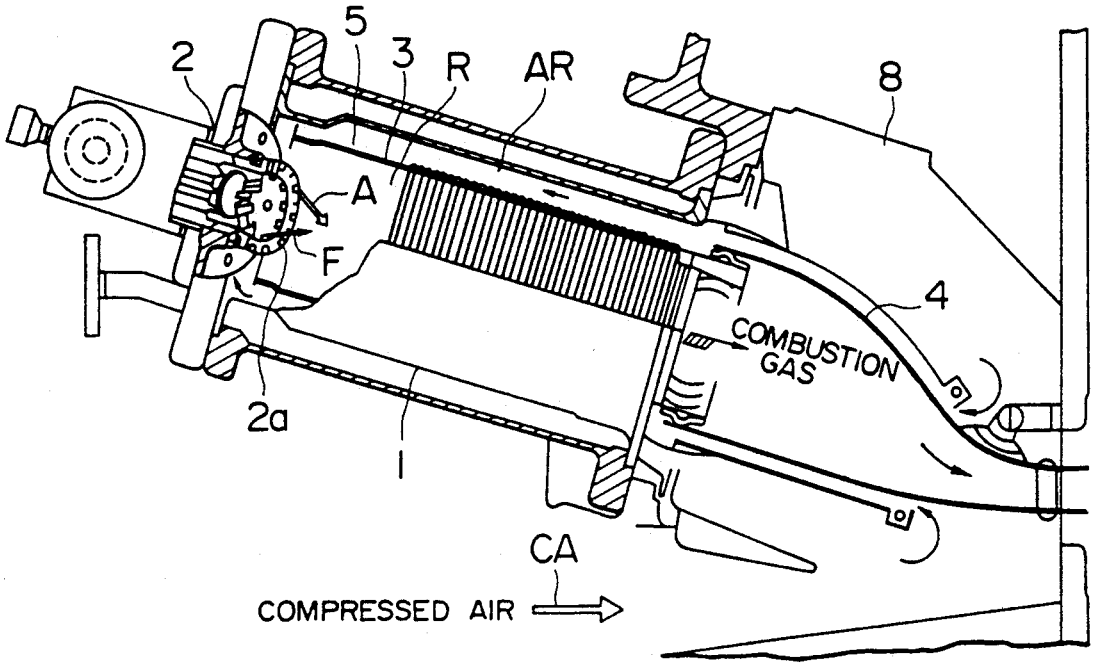
FIG. 3 is a longitudinal sectional view of an embodiment of the combustion apparatus according to the present invention.

As shown in FIG. 3, a combustion apparatus used, for example, in a gas turbine is composed mainly of a cover structure 1, a fuel supply means 2, a combustor liner 3 and a tail cylinder 4 with an interior R of the combustor liner forming a combustion chamber.

The fuel supply means 2 is mounted on one end of the combustor liner 3, i.e., on the upstream end as viewed in a flow direction of the combustion gas indicated by a feathered arrow, and is adapted to supply a mixed gas of a fuel F and air A into the combustion chamber R.

In order to attain a better mixing of the fuel with air and also to stabilize the flame, a swirler **2*a* is provided on the outlet end of the fuel supply means 2** so as to impart a swirling flow to the mixed gas.

Figure 4:
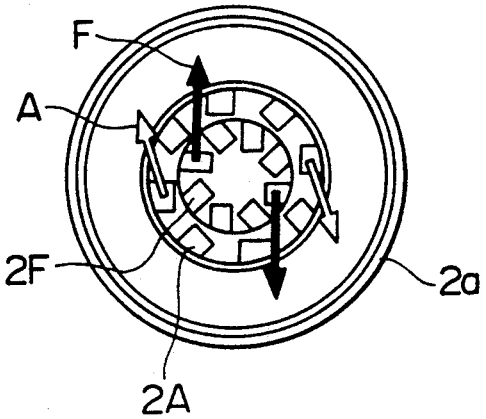
FIG. 4 is a front view of a swirler.

As shown in FIG. 4, the fuel nozzle has eight fuel ports 2F from which the fuel F is jetted at a predetermined angle with respect to the axis of the fuel nozzle. Consequently, the fuel F is directed towards the downstream in the form of a swirling flow. Similarly, air is jetted from air ports 2A at a predetermined angle with respect to the axis so as to form a swirling flow. In the illustrated embodiment, the fuel ports 2F and the air ports 2A are arranged at different radial positions. This, however, is not exclusive and these ports may be arranged on the same circle, i.e., at the same radius from the center of the nozzle.

Referring again to FIG. 3, the combustor liner 3 forming the combustion chamber R has a cylindrical form extending in the direction of the combustion gas flow, and is arranged in the cover structure 1, with a predetermined gap AR being maintained between a combustor liner and the inner wall of the cover structure 1. This gap forms a passage AR for cooling air.

The combustor liner 3 is subjected to heat of the combustion gas, so that it is heated up to a high temperature during operation therefore the combustor liner 3 is provided on the inner surface thereof with a cooling means 5.

Figure 1:
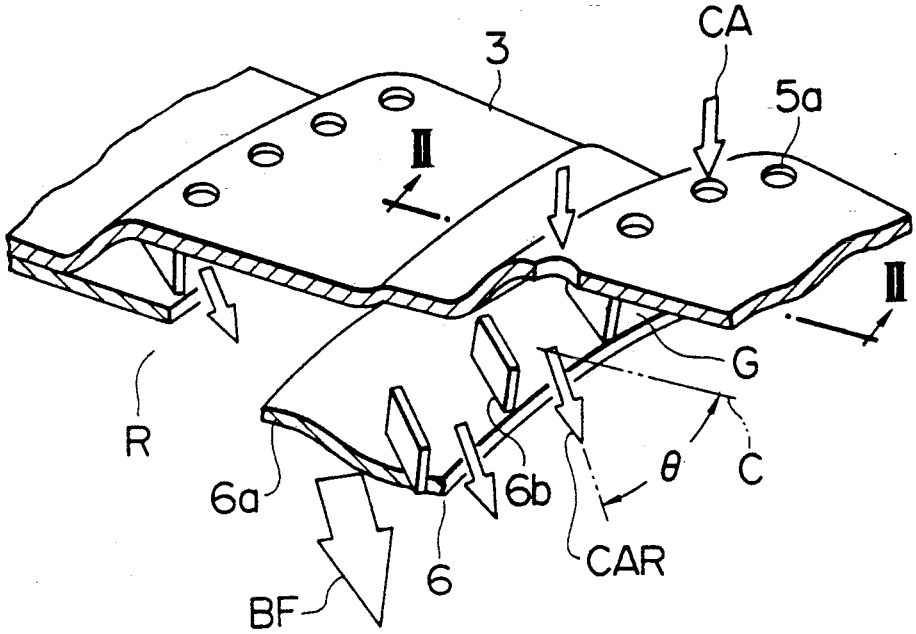
FIG. 1 is a fragmentary perspective view of a combustor liner in an embodiment of the combustion apparatus according to the present invention.

As shown in FIG. 1, a cooling means 5 for includes cooling air supply ports 5*a* which penetrate the wall thereof, with the respective air supply ports 5*a* being provided inside thereof with lips 6*a*.

As will be seen from FIG. 1, the configuration of the lip 6*a* and the positional relationship between the lip 6*a* and the cooling air supply ports 5*a* are set such that each lip 6*a* is disposed inside each row of the cooling air supply ports 5*a* and the downstream side of each lip 6*a* is unsupported, so that a small gap G, serving as air outlet, is formed between the downstream side of the lip 6*a* and the inner wall of the combustor liner 3.

As will be described later, cooling air which is jetted through this air outlet gap G forms a film of cooling air which effectively prevents the combustor liner from becoming hot.

Further, as will be seen from FIG. 1, a plurality of protrusions 6*b* are provided on the surface of the lip 6*a* so as to project into the outlet gap G and to extend toward the downstream side at an angle $\theta$ with respect to the axis C of the combustor liner 3.

The inclination angle $\theta$ of the protrusions 6*b* with respect to the liner axis C is set such that the cooling air jetted from the outlet gap G is directed in the same direction as the flowing direction of the combustion gas formed by the swirler 2*a*.

The lips 6*a*, cooling air supply ports 5*a* and the protrusions 6*b* in cooperation form an air film forming means 6.

In operation referring to FIG. 3, compressed air CA is introduced into an impeller housing 8 formed around the tail cylinder 4 and here its pressure is recovered. The air of the increased pressure then flows through the space around the tail cylinder 4 and the combustor liner towards the upstream side, i.e., towards the fuel supply means, and is introduced into the combustion chamber R. The air introduced into the combustion chamber R is divided into at least two flows.

One flow is introduced, as the film of cooling air, through the small outlet gap G formed between the combustor liner 3 and the lips 6*a*. The other flow is introduced, as the combustion air, from the swirler 2*a* of the fuel supply means 2.

Figure 5:
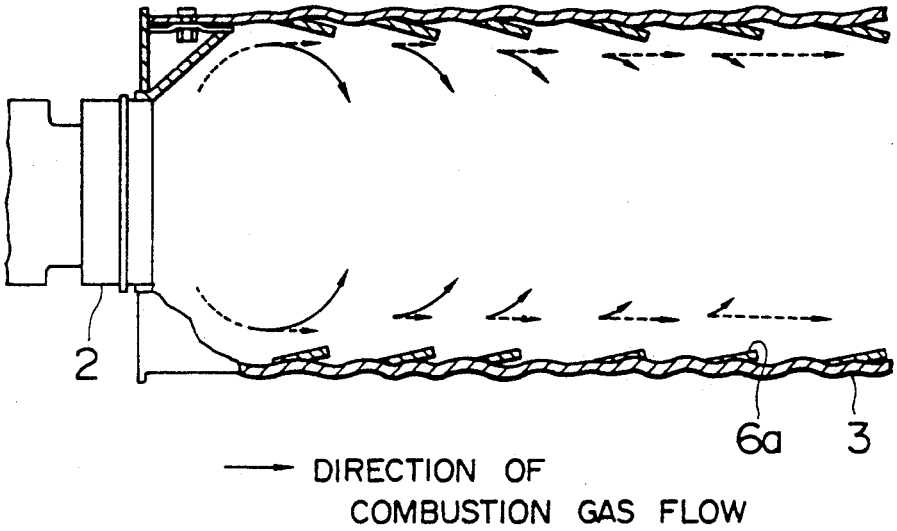
FIG. 5 is a longitudinal sectional view of a combustor liner.

Needless to say, the combustion air flows into the combustion chamber R after being mixed with the fuel. Also in this case, as explained before, since both the combustion air and the fuel are supplied through the swirler at an angle with respect to the axis C of the liner, the mixed gas forms a swirl which progressively moves in the liner towards the downstream side while burning. This state is indicated by solid-line arrows in FIG. 5.

Figure 2:
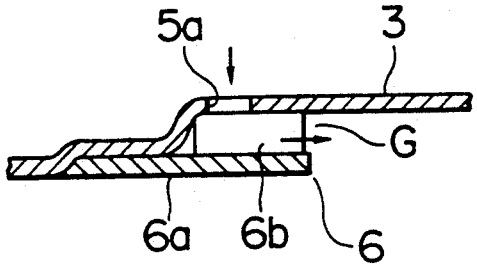
FIG. 2 is a sectional view taken along the line II—II of FIG. 1.

Further, the flow of the combustion gas is also indicated by a large arrow BF in FIG. 1. Incidentally, a small arrow CAR in FIGS. 1 and 2 indicates the flow of the film forming air which is important for the present invention. Thus, the air jetted from the air film forming means 6 is deflected by the protrusions 6*b* so as to flow into the combustion chamber R at the inclination angle $\theta$ with respect to the liner axis C.

In this case, since this inclination angle $\theta$ is set to direct the cooling air in the same direction as the direction BF of the swirling combustion gas flow, the cooling air CAR flows in the same direction as the combustion gas, so that the flow of the film forming air is not disturbed or stirred by the combustion gas. Therefore, the film forming air can stably form a uniform film of cooling air without being affected by the flow of the combustion gas, even if the diameter of the combustor liner 3 is small.

Figure 6:
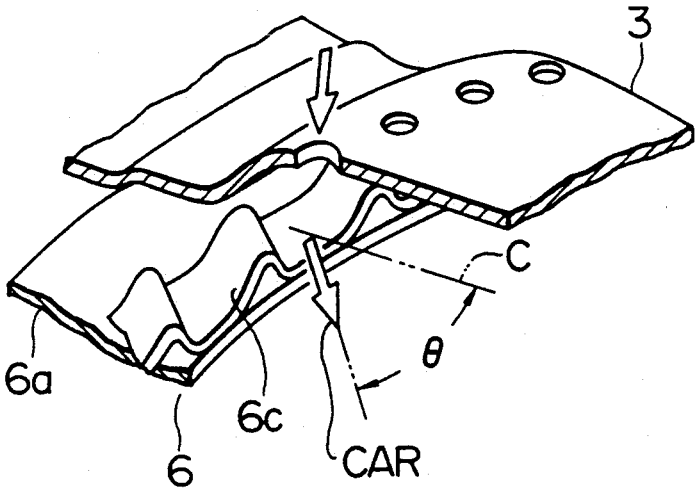
FIG. 6 is a fragmentary perspective view of a combustor liner in another embodiment of the combustion apparatus according to the present invention.

In the embodiment described hereinbefore, the protrusions 6*b* on the lips 6*a* are used for deflecting the flow of the film forming air in the same direction as the flowing direction of the combustion gas. This arrangement, however, is not exclusive and the same effect is produced when, as shown in FIG. 6, a corrugated plate 6*c* having inclined corrugations is interposed between each lip 6*a* and the combustor liner 3. In such a case, the corrugations of the corrugated plate 6*c* are inclined to direct the cooling air in the same direction as the flowing direction of the combustion gas.

It will be understood that the arrangement shown in FIG. 6 produces the same effect as that produced by the first embodiment described in connection with FIGS. 1 to 5. The arrangement shown in FIG. 6 also offers an additional advantage over the first embodiment. In the first embodiment of FIGS. 1–5, the flow of the cooling air is slightly broken by the protrusions 6*b*, so that the film of the cooling air tends to become discontinuous in the circumferential direction. In contrast, in the embodiment shown in FIG. 6, variation in the flow velocity of the cooling air takes place in the thickness wise direction of the air film, so that the breakage penetrating the cooling air film does not occur, thereby making it possible to form the air film which is more sufficient than that formed by the former embodiment.

Figure 7:
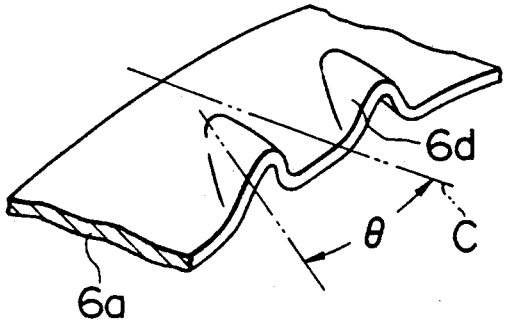
FIG. 7 is a fragmentary perspective view of a combustor liner in a still another embodiment of the combustion apparatus according to the present invention, showing particularly a lip portion.
Figure 8:
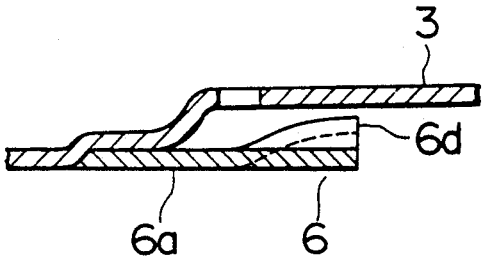
FIG. 8 is a longitudinal sectional view of the lip portion thereof.

In the embodiment of FIG. 7 in the lips 6*a* itself have integral protrusions 6*d*, unlike the embodiment of FIGS. 1–5 in which the protrusions 6*b* are formed as separate members. More specifically, the protrusions 6*d* are formed on the outlet side of the lip 6*a*, with their axes being inclined at the angle $\theta$ with respect to the axis C of the combustor liner 3. It will be understood that these protrusions 6*d* serve to direct the flow of the cooling air in the same direction as the swirling direction of the combustion gas.

Thus, the embodiment shown in FIG. 7 offers the same advantages as those produced by the preceding embodiments. In addition, the arrangement shown in FIG. 7 can easily be attained only by pressing the lip 6*a*. Accordingly, the production process is simplified because there is no need to attach the separate members such as the protrusions 6*b* in the first embodiment or the corrugated plate 6*c* in the second embodiment, and the lip itself becomes robust due to the protrusions 6*d*.

Although various air film forming means have been described, these are only illustrative, and various other measures can be taken such as to modify the through-holes, i.e., the cooling air supply ports formed in the combustor liner, so as to jet the cooling air in a desired direction or to suitably vary the circumferential pitch and the number of the protrusions thereby attaining good balance and distribution of the cooling air.

In the described embodiments, the air film forming means is so constructed as to direct the air at a certain inclination angle with respect to the axis of the liner. This angle, however, may be varied along the length of the combustor liner.

The spiral pitch of the swirl of the combustion gas in the combustor liner is not constant. Namely, the pitch of the swirl of the combustion gas progressively increases towards the downstream side. In other words, the angle of the spiral form of the swirl progressively decreases towards the downstream side of the combustor liner.

Figure 9:
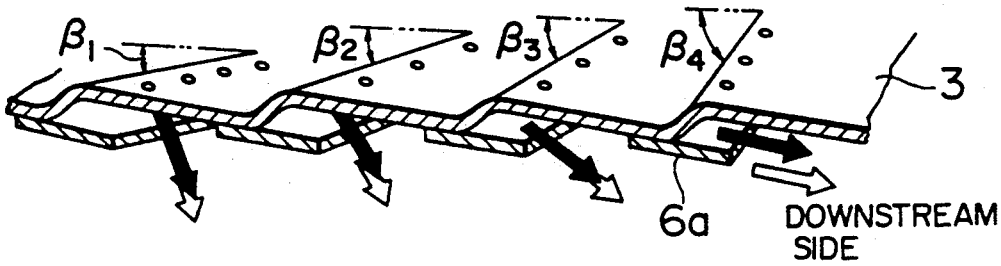
FIG. 9 is a fragmentary perspective view of a combustor liner in a further embodiment of the combustion apparatus according to the present invention.

It is therefore most preferable that the air film forming means is so constructed that, as shown in FIG. 9, the jetting angle of the cooling air is progressively and gently decreased towards the downstream side of the combustor liner. That is, FIG. 9 shows an embodiment in which the lip 6*a* has a spiral form, and a symbol $\beta_1$ represents the inclination angle of the combustion gas with respect to the axis of the combustor liner at its upstream side. The inclination angle $\beta$ then progressively changes to $\beta_2$, $\beta_3$, $\beta_4$ and so on towards the downstream side of the combustor liner so as to meet the condition of $\beta_1<\beta_2<\beta_3<\beta_4$. Needless to say, the angle $\beta$ becomes 90° finally.

The cooling air is jetted from each of the lips 6*a* so as to flow along the wall of the liner. In this case, the direction (black arrow) of the cooling air jetted from the lip 6*a* is set to be $(90°-\beta)$ so as to become the same as the direction (white arrow) of the circumferential flow component of the combustion gas.

According to this arrangement, the direction of the film forming cooling air jetted from the lip substantially coincides with the direction of the main flow component of the combustion gas in the vicinity of the liner wall over the entire axial length of the liner. Thus, the film forming air flows substantially in parallel with the swirl of the combustion gas over the entire length of the combustor liner, thereby minimizing the disturbance of the film of the cooling air by the combustion gas, as well as mixing of the cooling air with the combustion gas. Consequently, the temperature rise of the combustor liner 3 is effectively lip, i.e., at the upstream side of the next lip.

As has been described, according to the present invention, the air film forming means is so constructed that the flowing direction of the cooling air forming the air film becomes the same direction as the swirling direction of the combustion gas. Therefore, the film of the cooling air is not broken by the flow of the combustion gas even if the swirling combustion gas reaches the same region as the film of cooling air, so that it possible to obtain a combustor liner of this type in which the cooling air film is difficult to be broken, without increasing the diameter of the combustor liner.

What is claimed is:

1. A combustion method, the method comprising the steps of:

supplying a premixed air-fuel in a swirling manner into a combustion chamber formed inside a cylindrical liner through an air-fuel supply means disposed at a most upstream side of the combustion chamber;

combusting the premixed air-fuel in a combustion chamber, and forming a film of air on an inner peripheral wall of the combustion chamber during combustion of the air-fuel, wherein the step of supplying includes injecting fuel into the combustion chamber through an injection nozzle such that the fuel is injected in a direction inclined with respect to a longitudinal direction of said cylindrical liner and in a circumferential direction of said liner, and wherein the step of forming includes directing a flow of the air forming said air film along the inner peripheral wall in the same direction as the swirling direction of the premixed air-fuel.

2. A combustion method in a combustion apparatus comprising a combustion chamber formed inside a cylindrical liner, an air film forming means provided on a wall of said cylindrical liner and adapted to form a film of air on the inner peripheral wall of said cylindrical liner, a fuel gas supplying means provided on one end of said combustor liner and adapted to supply a fuel gas into said combustion chamber, and a swirler provided on an outlet end of said fuel gas supplying means and adapted to impart a swirling flow to said fuel gas, the method comprising the steps of:

injecting fuel gas into the combustion chamber through an injection nozzle disposed at a most upstream side of the combustion chamber in such a manner that the fuel gas is injected in a direction inclined in a longitudinal direction of said cylindrical liner and a circumferential direction of said cylindrical liner, combusting said fuel gas in said combustion chamber while forming the film of air on the inner peripheral wall of said cylindrical liner by said air film forming means, and directing the flow of the air forming said air film in the same direction as a swirling direction of said fuel gas.

3. A combustion method, the method comprising the steps of:

supplying a premixed air-fuel in a swirling manner into a combustion chamber formed inside a cylindrical liner, combusting said premixed air-fuel, and supplying an air for forming an air film on an inner peripheral wall of the combustion chamber in the same direction as a swirling direction of the premixed air-fuel, and wherein the step of supplying includes injecting fuel into the combustion chamber through an injection nozzle disposed at a most upstream side of the combustion chamber in such a manner that the fuel is injected in a direction inclined with respect to a longitudinal direction of said cylindrical liner and in a circumferential direction of the liner.

4. A combustion apparatus for a gas turbine, the apparatus comprising:

a combustion chamber formed inside of a combustion liner, an air film forming means provided on an inner wall of said combustion liner and adapted to form a film of air along the inner wall of the combustion liner, a combustible gas supplying means provided at a most upstream end of said combustion chamber and adapted to supply a fuel and air into said combustion chamber, a swirler provided on an outlet end of said combustible gas supplying means and adapted to impart a swirling flow to the combustible gas, wherein said air film formed by said air film forming means protects said combustor liner from hot combustion gas, a direction of the air forming said air film is coincidental with a swirling direction of said combustible gas, and wherein a combustible gas injection nozzle injects the combustible gas in a direction inclined with respect to a longitudinal direction of said combustion liner and in a circumferential direction of said combustion liner.

5. A combustion gas apparatus comprising:

a combustion chamber formed inside a cylindrical liner;

an air film forming means provided on a wall of said cylindrical liner and adapted to form a film of air flowing along an inner peripheral wall of said cylindrical liner;

a fuel gas supplying means provided at a most upstream end of said cylindrical liner and adapted to supply a fuel gas into said combustion chamber;

a swirler provided on an outlet end of said fuel gas supplying means and adapted to impart a swirling flow to said fuel gas, wherein said film of air protects said combustor liner from the hot combustion gas, said air film forming means is formed such that a flow direction of the air forming said film of air is in the same direction as a swirling direction of said fuel gas, and wherein the fuel gas supplying means includes a fuel gas injection nozzle for injecting the fuel gas in a direction inclined with respect to a longitudinal direction of said cylindrical liner and in a circumferential direction of said cylindrical liner.

6. A combustion gas apparatus comprising:

a combustion chamber formed inside a cylindrical liner;

an air film forming means provided on a wall of said cylindrical liner and adapted to form a film of air flowing along an inner peripheral wall of said cylindrical liner;

a fuel gas supplying means provided at a most upstream end of said combustion chamber and adapted to supply a fuel gas into said combustion chamber;

a swirler provided on an outlet end of said fuel gas supplying means and adapted to impart a swirling flow to said fuel gas, wherein said film of air protects said combustor liner from hot combustion gas, said air film forming means is formed such that a jetting direction of the air forming said film is the same as a jetting direction of said fuel gas, and wherein said fuel gas supplying means includes a fuel gas injector for injecting the fuel gas in a direction inclined with respect to a longitudinal direction of said cylindrical liner and in a circumferential direction of said cylindrical liner.

7. A combustion apparatus comprising:

a combustion chamber formed inside a cylindrical liner;

an air film forming means provided on a wall of said cylindrical liner and adapted to form a film of air flowing along an inner peripheral wall of said cylindrical liner;

a fuel gas supplying means provided at a most upstream end of said combustion chamber and adapted to supply a fuel gas into said combustion chamber;

a swirler provided on an outlet end of said fuel gas supplying means and adapted to impart a swirling flow to said fuel gas, wherein said film of air protects said combustor liner from the hot combustion gas, said air film forming means is formed such that air discharged from said air film forming means is discharged in the same direction as a flowing direction of said fuel gas, and wherein said fuel gas supplying means includes a fuel gas injector for injecting the fuel gas in a direction inclined with respect to a longitudinal direction of said cylindrical liner and in a circumferential direction of said cylindrical liner.

8. A combustion apparatus according to claim 7, wherein said air film forming means includes lips arranged on an inner wall of said cylindrical liner with a predetermined gap therebetween, and protrusions provided between said lip and the inner wall of said cylindrical liner and adapted to deflect the cooling air in the flowing direction of said fuel gas.

9. A combustion apparatus according to claim 8, wherein said protrusions are formed by curving and protruding said lips.

10. A combustion apparatus according to claim 8, wherein said protrusions are formed by interposing a corrugated plate having inclined corrugations between said lips and the inner wall of said cylindrical liner.

11. A combustion apparatus comprising:

a combustion chamber formed inside the cylindrical liner;

an air film forming means provided on a wall of said cylindrical liner and adapted to form a film of air flowing along an inner peripheral wall of said cylindrical liner;

fuel gas supplying means provided at a most upstream end of said combustion chamber and adapted to supply a fuel gas into said combustion chamber;

a swirler provided on an outlet end of said fuel gas supplying means and adapted to impart a swirling flow to said fuel gas, said film of air protecting said combustor liner from hot combustion gas, wherein said air film forming means is formed such that a flow direction of the air forming said film is in the same direction as a swirling direction of said fuel gas, an angle of said flow direction of air with respect to a center axis of said cylindrical liner progressively decreases in a direction towards a downstream side of said combustor liner, and wherein said fuel gas supplying means includes a fuel gas injector for injecting the fuel gas in a direction inclined with respect to a longitudinal direction of said cylindrical liner and in a circumferential direction of said cylindrical liner.

* * * * *